US005367858A

United States Patent [19]

Haasl

[11] Patent Number: 5,367,858

[45] Date of Patent: Nov. 29, 1994

[54] SLEEVING SYSTEM

[75] Inventor: Andrew L. Haasl, Green Bay, Wis.

[73] Assignee: Development Industries of Green Bay, Inc., Green Bay, Wis.

[21] Appl. No.: 4,449

[22] Filed: Jan. 14, 1993

[51] Int. Cl.[5] ..... B65B 25/14; B65B 35/50; B65B 63/02

[52] U.S. Cl. ..... 53/439; 53/386.1; 53/389.3; 53/389.4; 53/528

[58] Field of Search ..... 53/528, 529, 439, 438, 53/572, 459, 567, 389.3, 389.4, 389.2, 384.1, 386.1, 399

[56] References Cited

U.S. PATENT DOCUMENTS

| | | | |
|---|---|---|---|
| 2,636,654 | 4/1953 | Sykes . | |
| 2,721,017 | 10/1955 | Hiscock | 226/53 |
| 2,737,002 | 3/1956 | Demler . | |
| 3,006,119 | 10/1961 | Fingerhut . | |
| 3,057,125 | 10/1962 | Jensen et al. . | |
| 3,063,215 | 11/1962 | Parks | 53/388 |
| 3,069,826 | 12/1962 | Littlefield et al. | 53/230 |
| 3,099,118 | 7/1963 | Stelling, Jr. | 53/209 |
| 3,166,462 | 1/1965 | Schoder | 53/499 |
| 3,238,697 | 3/1966 | Zucker | 53/230 |
| 3,327,452 | 6/1967 | Cranston, Jr. et al. | 53/218 |
| 3,343,334 | 9/1967 | Bode et al. | 53/528 |
| 3,417,544 | 12/1968 | Grevich . | |
| 3,445,983 | 5/1969 | Stevens | 53/52 |
| 3,507,091 | 4/1970 | Mizelle et al. . | |
| 3,545,166 | 12/1970 | Johnson et al. | 53/459 |
| 3,604,182 | 9/1971 | Jepsen | 53/209 X |
| 3,643,399 | 2/1972 | Bertoglio . | |
| 3,701,232 | 10/1972 | Parker | 53/570 |
| 3,729,886 | 5/1973 | Lucas et al. | 53/209 X |
| 3,731,452 | 5/1973 | Rias | 53/570 X |
| 3,775,930 | 12/1973 | Mercer et al. | 53/209 X |
| 3,837,138 | 9/1974 | Terry . | |
| 3,848,398 | 11/1974 | Suhr . | |
| 3,928,941 | 12/1975 | Singer . | |
| 3,952,479 | 4/1976 | Achelpohl | 53/384 X |
| 3,975,888 | 8/1976 | Jones | 53/386 |
| 4,047,362 | 9/1977 | Lister et al. | 53/572 |
| 4,242,854 | 1/1981 | Nissen | 53/529 |
| 4,328,655 | 5/1982 | Spencer et al. | 53/439 |
| 4,592,193 | 6/1986 | Gustavsson | 53/530 |
| 4,626,236 | 12/1986 | Maurer | 53/386.1 X |
| 4,748,799 | 6/1988 | Truc et al. | 53/457 |
| 4,858,416 | 8/1989 | Monaghan | 53/439 |
| 4,875,328 | 10/1989 | Meyer | 53/529 |

*Primary Examiner*—James F. Coan

*Attorney, Agent, or Firm*—Andrus, Sceales, Starke & Sawall

[57] ABSTRACT

A sleeving system consists of a sleeve forming mechanism for constructing a sleeve from a web of material and a series of pairs of prongs mounted to a pivoting turret mechanism. The prongs are moved to a collapsed position, where a partially opened sleeve is positioned over the collapsed prongs and clamped to one of the prongs. The prongs are pivoted to an inserting station, and are moved apart to open the sleeve at the inserting station. A compressed stack of articles, such as paper towels, is provided to the inserting station, and is inserted by an inserting mechanism into the space between the prongs, and therefore into the opened sleeve. The prongs are then pivoted to a removal station, where a removing mechanism functions to remove the stack from between the prongs and to simultaneously draw the sleeve off of the prongs. The stack undergoes decompression as it emerges from between the prongs, to expand into engagement with the sleeve. The removing mechanism deposits the sleeved stack of articles onto a discharge conveyor. Several sets of prongs are mounted to the turret mechanism, which provides continuous indexing movement of the prongs between the sleeving, inserting and removal stations of the system.

20 Claims, 10 Drawing Sheets

20
22
24
26
28
30
32
34
36
40
42
44
46
48
50
66
73a
73b
94
96
98
100
102
104
106
108
110
112
118
120
122
124
126
128
130
132
134
136
142
144
146
12
14
3
390
328
336
296A
296B
296C
296D 84
80
78

90
82
40
74
64
83
76
66
120
96
86
72
94
60
70
42
46
58
62
68
52
56
50
136
112
140
92
88
70
114
44
54
38
138
116

318
316
312
314
310
306

30
301
302
304
186
309
320
326
13
323
352
352
344
324
32
342
188
340
334
13

FIG. 4
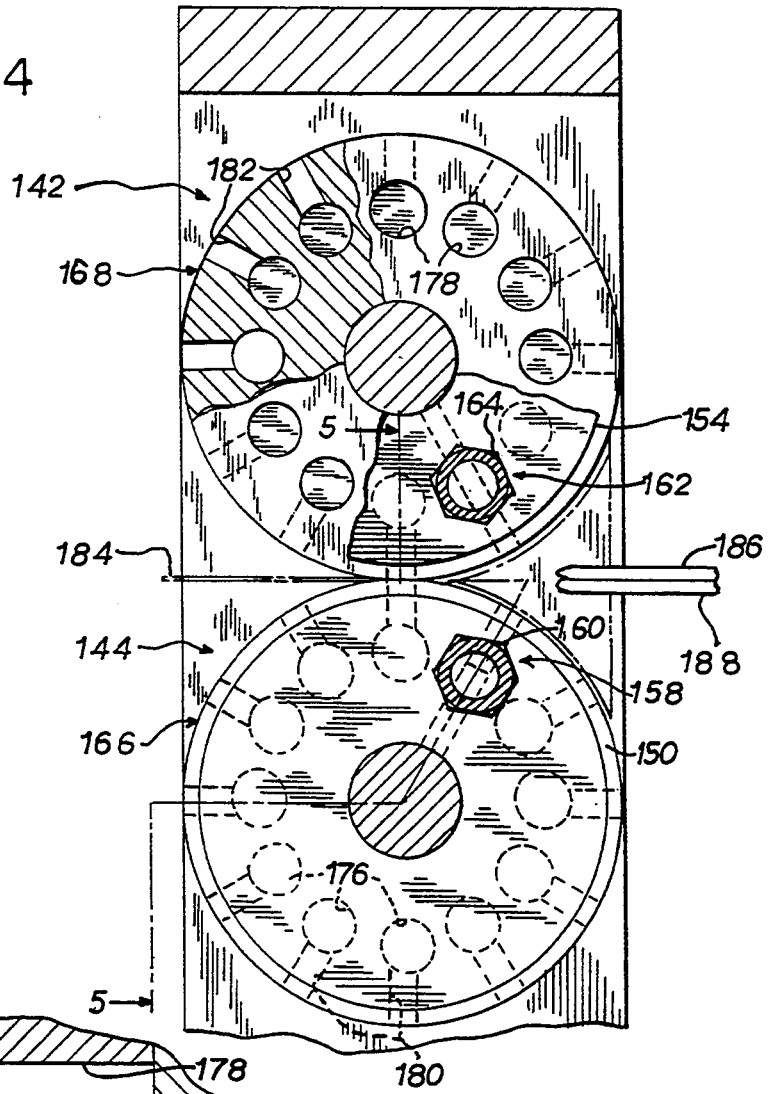
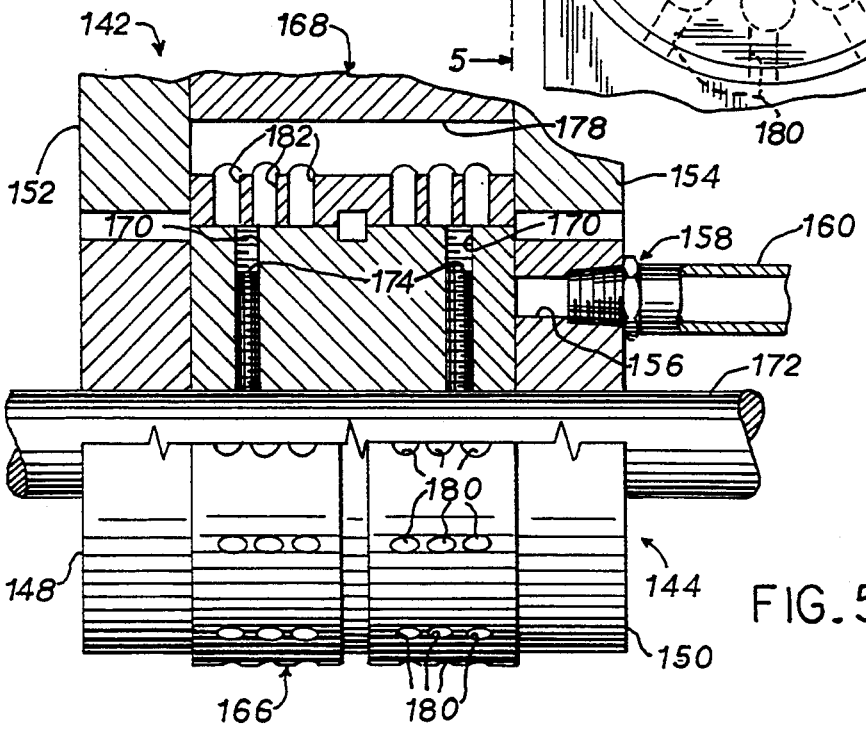
FIG. 5

26
224
224
196
7
230
186B
202
232
200
192
194
186A
186C
228
186D
226
232
232
9
9
7
224
198
8
8

34
200
6
6
30
310
302
198
318
312
310
308
32
320
320
340
334
332
328
330
336
340
294D
292D
322
322
28
292C
294C
298C
296C
296D
292B
294B
298B
296B
300A
292A
294A
298A
296A 16
16
15
15
34
368
354
358
356
380
382
374
360
378
186
200
376
188
378

FIG.13
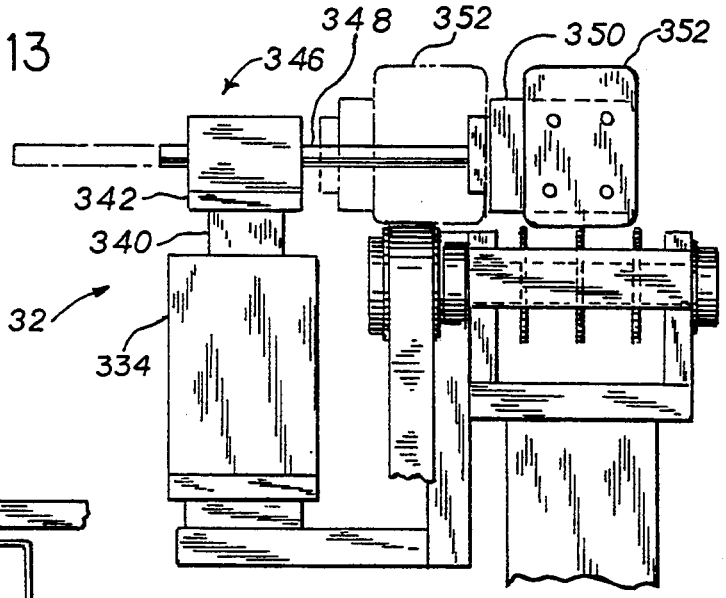
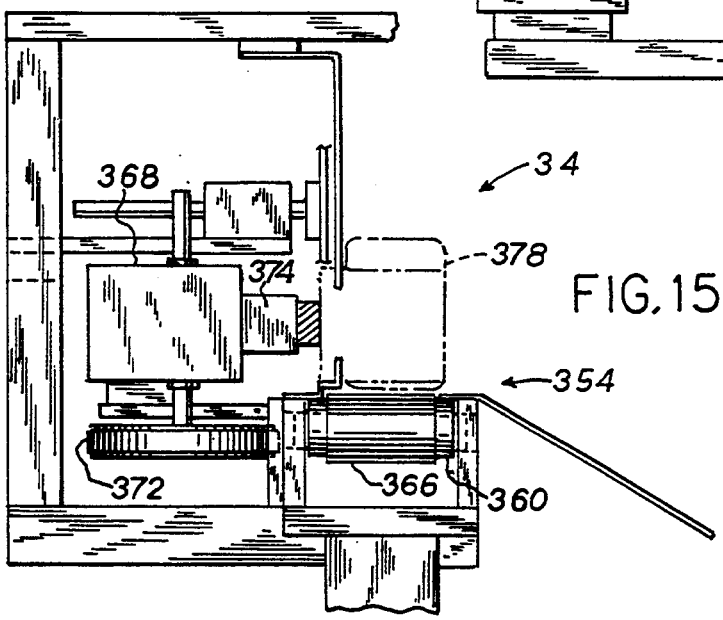
FIG.15
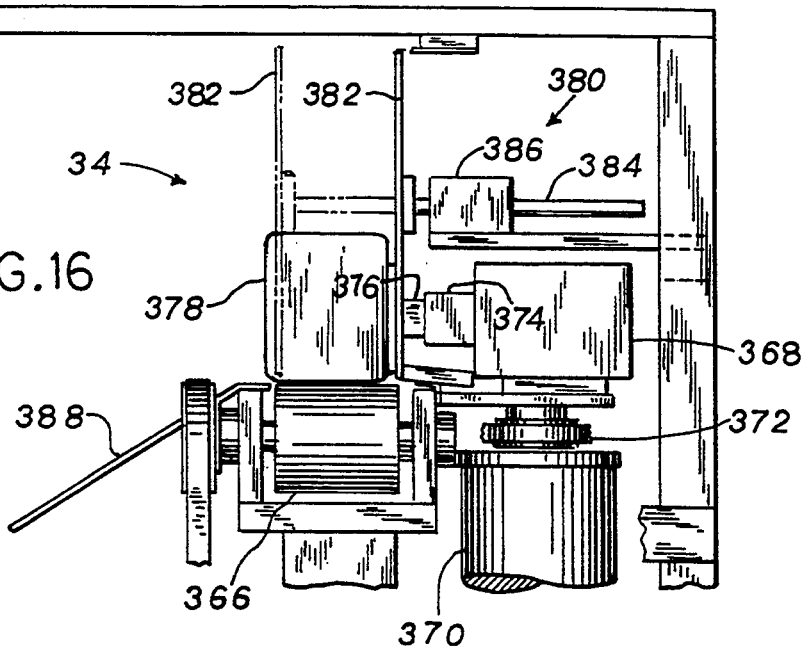
FIG.16

SLEEVING SYSTEM

BACKGROUND AND SUMMARY

This invention pertains to a packaging system, and more particularly to a system for enclosing a compressible stack of articles within a sleeve.

Various mechanisms are known for packaging a compressible stack of articles, such as a stack of paper towels or the like. One such device is enclosed in Lucas et al U.S. Pat. No. 3,729,886 issued May 1, 1973, and entitled Method and Apparatus For Banding Articles. This patent discloses advancing the stack of articles by means of a pair of conveyors defining facing upper and lower runs. The conveyor runs converge toward each other, so that the stack is compressed as it is being advanced by the conveyors. A sheet of material is applied to the top of the compressed stack, and is folded down along the sides of the stack and under the bottom of the stack, all while the stack remains under compression. An adhesive is applied between areas of the sheet which are folded onto each other, to form the sheet into a band which encircles the stack of articles. The stack is advanced while remaining under compression, allowing the adhesive to set, after which the banded stack is discharged from between the conveyor runs. The stack undergoes decompression, and is retained within the band by friction between the stack and the band.

An improved version of the above-summarized machine involves supplying upper and lower webs of material to the top and bottom, respectively, of the compressed stack. The top web is folded down to partially cover the sides of the stack, and the bottom web is folded up to partially overlap the edges of the top web. Adhesive is applied between the overlapping portions of the top and bottom webs, and rollers apply pressure thereto. The stack remains under compression until the adhesive sets, after which it is discharged from between the upper and lower conveyor runs.

It is an object of the present invention to provide an improved mechanism for packaging a compressible stack of articles, such as paper towels or the like. It is a further object of the invention to provide an article packaging system which results in production of a clean and neat package for the stack. Yet another object of the invention is to provide a compact and efficient packaging system for producing a packaged stack of articles.

In accordance with one aspect of the invention, a system for packaging a compressible stack of articles includes an article feeding mechanism for supplying the stack of articles in a compressed state, and a sleeve feeding mechanism for supplying a collapsible tubular sleeve in a collapsed condition, with the sleeve defining at least one open end. The invention further includes a sleeve opening mechanism for moving the sleeve from its collapsed condition to an open condition, and an inserting mechanism for inserting the compressed stack of articles into the open end of the sleeve when the sleeve is moved to its open condition by the sleeve opening mechanism. The invention further includes a removing mechanism for removing the sleeve and the stack of articles from the sleeve opening mechanism, which results in decompression of the stack and engagement of the stack with the sleeve, to retain the stack of articles within the sleeve by friction.

The sleeve opening mechanism consists of a pair of prongs, movable between a first collapsed position in which the prongs are close together, and a second opened position in which the prongs are moved apart. The sleeve feeding mechanism functions to place the sleeve onto the prongs when the prongs are in their first collapsed position. Movement of the prongs to their second opened position functions to open the sleeve, and the inserting mechanism is operable to insert the stack of articles into the open end of the sleeve between the prongs. The prongs are mounted to a pivoting turret mechanism which functions to move the prongs between a sleeving station, an inserting station, and a removal station. At the sleeving station, the prongs are in their first collapsed position and the sleeve feeding mechanism functions to place the sleeve onto the prongs. The sleeve opening mechanism functions to move the prongs from their first collapsed position to their second opened position during movement of the prongs between the sleeving station and the inserting station. At the inserting station, the stack of articles is inserted into the sleeve between the prongs. At the removal station, the removing mechanism functions to remove the sleeve and the stack of articles from the prongs.

The sleeve opening mechanism includes a guide track with which at least one of the prongs is interconnected. The guide track is arranged to provide movement of the prongs between their open and closed positions as the prongs are moved by pivoting movement of the turret mechanism.

The sleeve feeding mechanism functions to construct a sleeve from a parent roll of web material, by unwinding the web material from the parent roll, and folding and gluing the web material into a collapsed, folded tube. A cutting mechanism functions to cut the collapsed, folded tube into collapsed sleeves of predetermined length. The feeding mechanism includes a pair of rollers defining a nip for receiving the collapsed sleeve therebetween. Each roller includes one or more suction ports to which suction is applied. The suction ports function to draw the walls of the collapsed sleeve apart, to partially open the sleeve as the sleeve is propelled by the rollers toward and onto the sleeve opening mechanism.

The invention also contemplates a method of packaging a compressible stack of articles. The method involves the steps of providing a sleeve in a collapsed condition, with the sleeve defining at least one open end, and moving the sleeve to an open position for opening its open end. The method further includes compressing the stack of articles, inserting the compressed stack of articles into the open end of the sleeve, and decompressing the stack of articles, so that the articles engage the sleeve and are retained within the sleeve by friction. The details of the method are substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a partial side elevation view, with portions broken away, showing the suction roll assembly for supplying the partially opened sleeve to the collapsed prongs;

FIG. 5 is a partial section view taken along line 5—5 of FIG. 4;

FIG. 13 is a partial section view taken along line 13—13 of FIG. 12;

FIG. 15 is a partial section view taken along line 15—15 of FIG. 14;

FIG. 16 is a partial section view taken along line 16—16 of FIG. 14;

DETAILED DESCRIPTION OF THE INVENTION

Figures 1, 3:
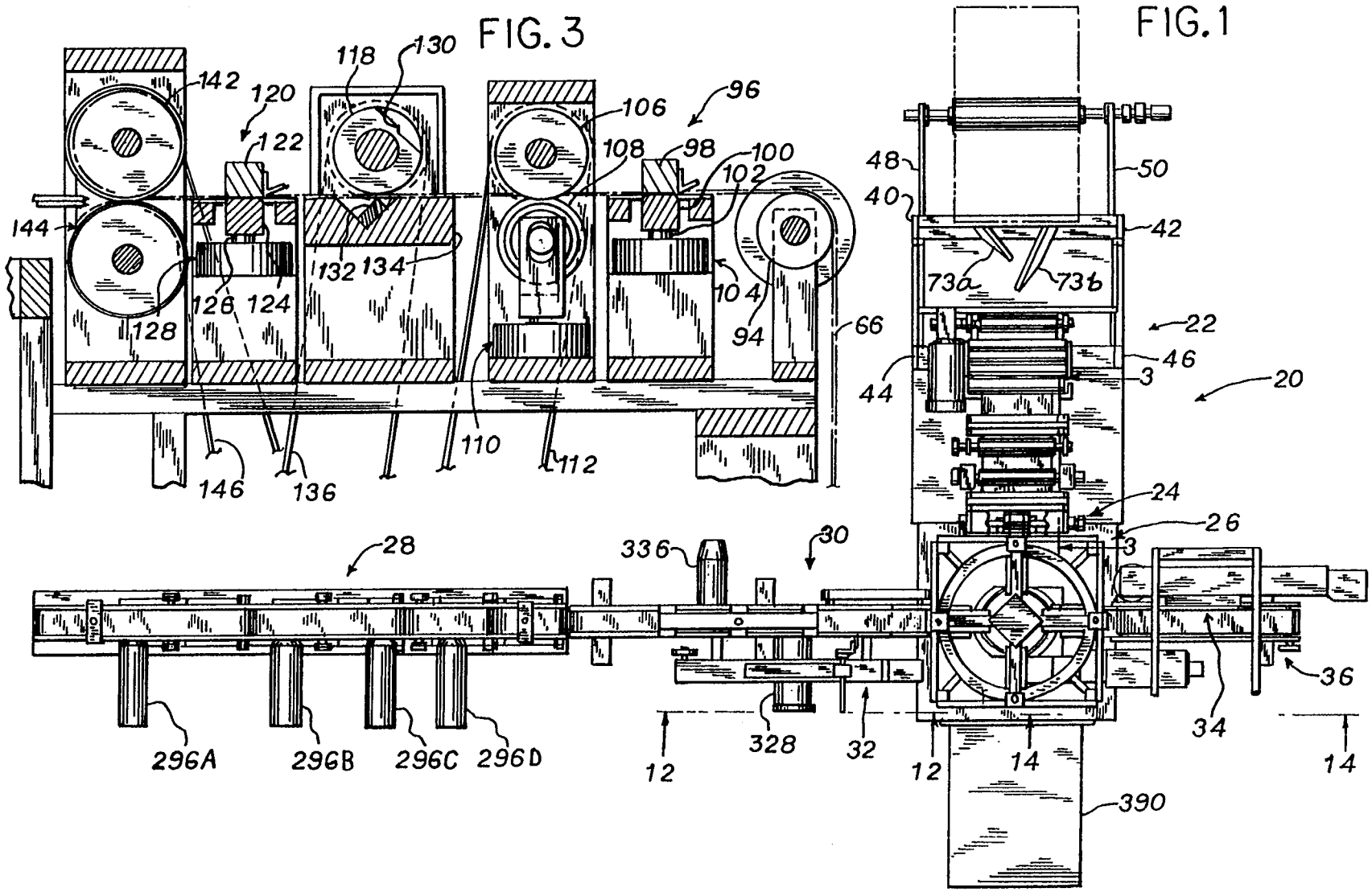
FIG. 1 is a top plan view of a sleeve-type packaging system constructed according to the invention.
FIG. 3 is an enlarged partial section view of the sleeve forming mechanism of FIG. 3, reference being made to line 3—3 of FIG. 1.

Referring to FIG. 1, a sleeving system constructed according to the invention is shown generally at 20. Generally, sleeving system 20 includes a sleeve forming mechanism 22, a sleeve supply mechanism 24, a turret-type sleeve opening mechanism 26, a supply conveyor 28, an in-feed conveyor 30, an inserting mechanism 32, a removing mechanism 34, and a discharge conveyor 36. Broadly, sleeving system 20 functions to package a compressible stack of articles, such as paper towels, within a paper sleeve. The sleeve is formed by sleeve forming section 22, and is supplied by sleeve supply mechanism 24 to sleeve opening mechanism 26. The stack of articles is supplied by supply conveyor 28 to in-feed conveyor 30, and is inserted into the opened sleeve by inserting mechanism 32. The stack of articles and the sleeve are removed from sleeve opening mechanism 26 by removing mechanism 34, and the packaged stack of articles is discharged by discharge conveyor 36.

The details of construction of the above subassemblies of sleeving system 20 will first be explained, followed by a detailed explanation of the manner in which the subassemblies operate individually and in cooperation with each other to package a stack within a sleeve.

Figure 2:
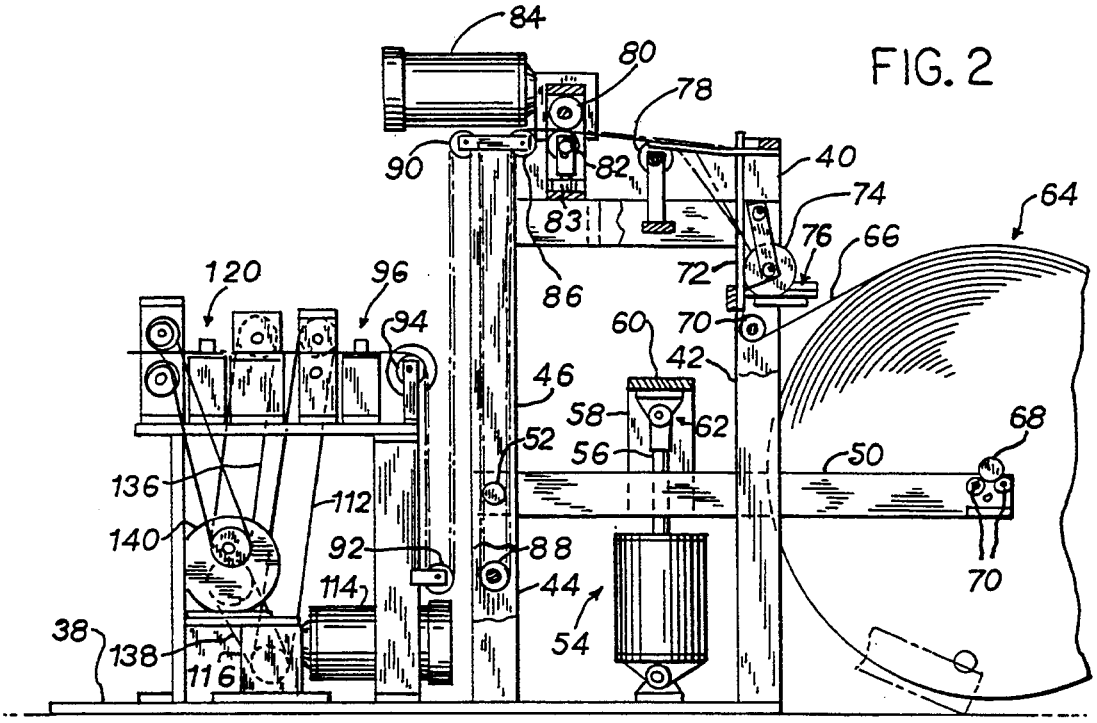
FIG. 2 is a side elevation view of the sleeve forming mechanism of the packaging system of FIG. 1.

Referring to FIGS. 1 and 2, sleeve forming mechanism 22 includes a frame assembly consisting of a base plate 38 and spaced pairs of upstanding vertical frame members 40, 42 and 44, 46. A pair of arms 48, 50 are pivotably mounted between frame members 44, 46 by means of a shaft 52, which is pivotably mounted at its ends to frame members 44, 46. A pneumatic cylinder assembly 54 includes an extendible and retractable rod 56 which is interconnected with arms 48, 50. A vertical frame member, such as shown at 58, extends upwardly from each of arms 48, 50, and a horizontal frame member 60 extends between the upper ends of the vertical frame members. A bracket and pin assembly 62 is interconnected between the upper end of rod 56 and horizontal frame member 60. With this arrangement, arms 48, 50 are pivotable about shaft 52 in response to extension and retraction of cylinder rod 56.

A parent roll 64 of web material, such as Kraft paper or the like, is supported by the outer ends of arms 48, 50. Roll 64 supplies a web of material, shown at 66. In a manner to be explained, web 66 is drawn from parent roll 64 and C-folded and glued to form a continuous tube, which is then severed to form individual sleeves. Pneumatic cylinder assembly 54 is operable to raise and lower arms 48, 50 to lift parent roll 64 upwardly off the floor or other supporting surface.

A shaft 68 is inserted through the core of parent roll 64, and is supported by a pair of cradle rollers, such as shown at 70, mounted to each of arms 48, 50. A pneumatic brake (not shown) is applied to core shaft 68, and the pressure exerted on shaft 68 is varied according to the diameter of parent roll 64, sensed by a photo eye.

From parent roll 64, web 66 is trained about a roll 70 located between frame members 40, 42. From roll 70, web 66 is drawn upwardly on a folding plate 72 which includes angled surfaces for folding the edges of web 66 inwardly in a C-fold manner. A pair of folding arms 73*a*, 73*b* (FIG. 1) engage web 66 to crease the folds created by folding plate 72. A glue roller 74 applies a line of glue from a reservoir 76 to the edge of web 66 prior to folding of web 66. When web 66 is folded by folding plate 72 and arms 73*a*, 73*b*, the edges of web 66 overlap each other with a line of glue therebetween. The C-folded web passes over a support roll 78 over which arms 73*a*, 73*b* are located, and then passes between a nip defined by a drive roll 80 and a nip roll 82. Nip roll 82 is mounted for vertical movement to the extendible and retractable rod of a pneumatic cylinder assembly 83. Drive roll 80 is driven in response to operation of an unwind motor 84. Operation of drive roll 80, in cooperation with nip roll 82, functions to draw web 66 from parent roll 64.

Downstream of the nip defined by drive roll 80 and nip roll 82, the folded and glued web 66 is in the form of a continuous collapsed tube, and is trained about an idler roll 86, a dancer roll 88, and idler rolls 90, 92 and 94. Dancer roll 88 is mounted between frame members 44, 46 within vertical slots formed in the facing surfaces of frame members 44, 46. Dancer roll 88 is thus vertically movable within the slots in frame members 44, 46 throughout a limited range of movement. Photo eyes (not shown) are mounted to one or the other of frame members 44, 46 for sensing the vertical position of dancer roll 88. The photo eyes are interconnected with motor 84 for controlling the speed at which web 66 is unwound from parent roll 64. An upper photo eye senses when dancer roll 88 reaches an upper predetermined position, and provides a signal to motor 84 to increase the speed at which web 66 is unwound from parent roll 64. A lower photo eye senses when dancer roll 88 reaches a lower predetermined position, to provide a signal to motor 84 to slow down the rate at which web 66 is unwound.

The serpentine path defined by rolls 86–94 provides an adequate amount of setting time for the glue applied by glue roller 74 to web 66.

Referring to FIGS. 2 and 3, the folded and glued web 66, now in the form of a collapsed tube, is supplied between a rear clamp assembly 96 consisting of a stationary upper block 98 and a lower block 100 mounted to an extendible and retractable rod 102 associated with a pneumatic cylinder assembly 104. The folded tube defined by web 66 then passes through a drive nip defined by a drive roll 106 and a nip roll 108, which is mounted for vertical movement to the rod of a pneumatic cylinder assembly 110. Drive roll 106 is driven in response to movement of a drive belt 112, which in turn is driven by a motor 114 (FIG. 2) through a gear box 116.

From the nip defined by drive roll 106 and nip roll 108, the folded tube defined by web 66 passes below a knife roll 118 to a forward clamp assembly 120. Forward clamp assembly 120 is substantially identical in construction to rear clamp assembly 96, consisting of an upper stationary block 122, and a lower block 124 mounted to the extendible and retractable rod 126 of a pneumatic cylinder assembly 128.

Knife roll 118 includes a knife 130 mounted thereto in a manner as is known. An anvil 132 is mounted within a recess formed in the upper surface of a support member 134. In a manner as is known, knife 130 and anvil 132 cooperate to sever the folded tube defined by web 66 upon rotation of knife roll 118. Knife roll 118 is driven by a belt 136, which in turn is driven by motor 114 and gear box 116 through a belt 138 and a single revolution clutch 140.

Rear clamp assembly 96 and forward clamp assembly 120 are operable to clamp the folded tube defined by web 66 during rotation of knife roll 118 to sever the folded tube against anvil 132. The severed portion of the folded tube thus forms a sleeve, which is continued to be clamped by forward clamp assembly 120. The folded sleeve is in a collapsed condition, and its downstream end is located in a nip defined by a pair of suction-type sleeve supply rolls 142, 144.

Sleeve supply rolls 142, 144 are both driven in response to movement of a chain 146, driven through single revolution clutch 140 by motor 114.

Alternatively, separate drive systems can be supplied for suction sleeve supply rolls 142, 144 and for knife roll 118.

The details of construction of suction sleeve supply rolls 142, 144 are illustrated in FIGS. 4 and 5. Suction rolls 142, 144 are substantially identical in construction and operation.

Suction roll 144 includes a pair of spaced stationary side plates 148, 150, preferably formed of an ultra-high molecular weight nylon material. Suction roll 142 includes a similar pair of stationary plates 152, 154. A suction supply passage 156 is formed in plate 150, extending between its inner and outer surfaces. A fitting 158 is mounted to plate 150 at passage 156, and a suction supply tube 160 is connected to fitting 158. Referring to FIG. 4, fitting 158 is at a one o'clock position on stationary plate 150. Plate 154 of suction roll 142 similarly includes a fitting 162 and a tube 164 for supplying suction to a suction supply passage formed in plate 154. Fitting 162 is located at five o'clock position on plate 154.

Suction roll 144 further includes a metal roller member 166 located between plates 148, 150, and suction roll 142 similarly includes a metal roller member 168.

Referring to FIG. 5, a pair of radial threaded passages 170 are formed in roller member 166, extending between its outer surface and a central passage within which a drive shaft 172 is located. Drive shaft 172 is interconnected with chain 146 through a sprocket, in a manner as is known. A pair of set screws 174 are mounted within passages 170. The ends of set screws 174 are turned into engagement with drive shaft 172, for non-rotatably mounting roller member 166 to drive shaft 172. A similar arrangement is provided for roller member 168.

A series of transverse primary suction passages 176 are formed in roller member 166. Passages 176 extend between the opposite sides of roller member 166, and are provided at equal spacing between the two o'clock and twelve o'clock positions of roller member 166. A similar series of primary suction passages 178 are formed in roller member 168. Secondary suction passages 180 extend between primary suction passages 176 and the outer surface of roller member 166. Similarly, secondary suction passages 182 extend between primary suction passages 176 and the outer surface of roller member 168.

A collapsed sleeve, shown at 184 (FIG. 4) is supplied between suction rolls 142, 144 as previously described. Rotation of roller members 166, 168 functions to propel sleeve 184 rightwardly (FIG. 4), toward a pair of prongs 186, 188, the function of which will later be explained. During rotation of roller members 166, 168, the lower wall of collapsed sleeve 184 is subjected to suction at the one o'clock position as roller member 166 rotates clockwise, through secondary suction passages 180 as the primary suction passages 176 pass over suction supply passage 156 formed in plate 150. Similarly, the upper wall of collapsed sleeve 184 is subjected to suction at the five o'clock position during counterclockwise rotation of roller member 168, through secondary suction passages 182 as primary suction passages 178 pass over the passage in plate 154 to which suction is supplied through fitting 162 in tube 164. This supply of suction to the upper and lower walls of collapsed sleeve 184 functions to partially open sleeve 184 so that sleeve 184 is placed onto prongs 186, 188 as sleeve 184 is propelled rightwardly by rotation of roller members 166, 168.

Figure 6:
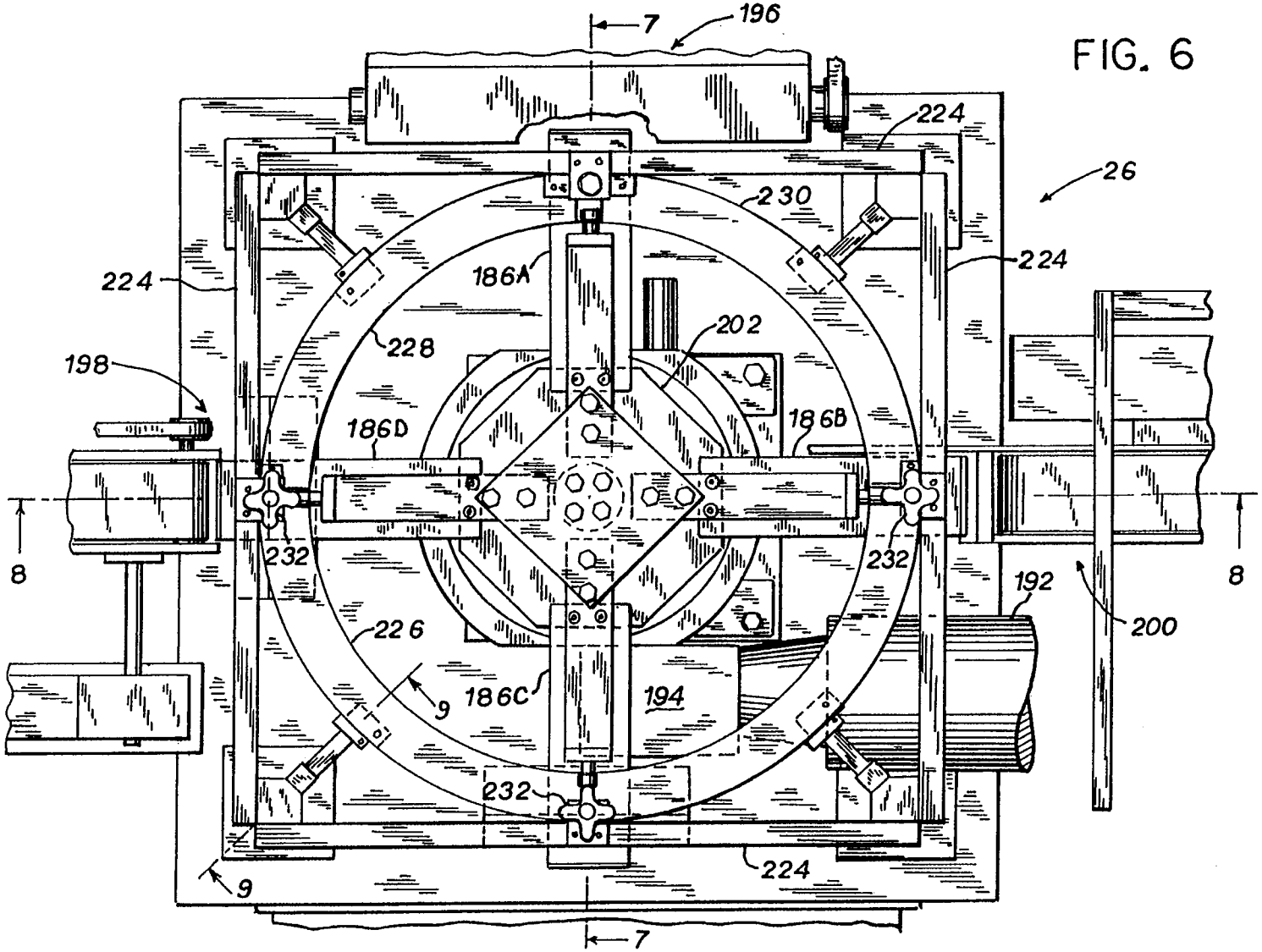
FIG. 6 is a top plan view of the turret mechanism and guide track arrangement for moving the prongs between their open and closed positions, reference being made to line 6—6 of FIG. 2.
Figure 7:
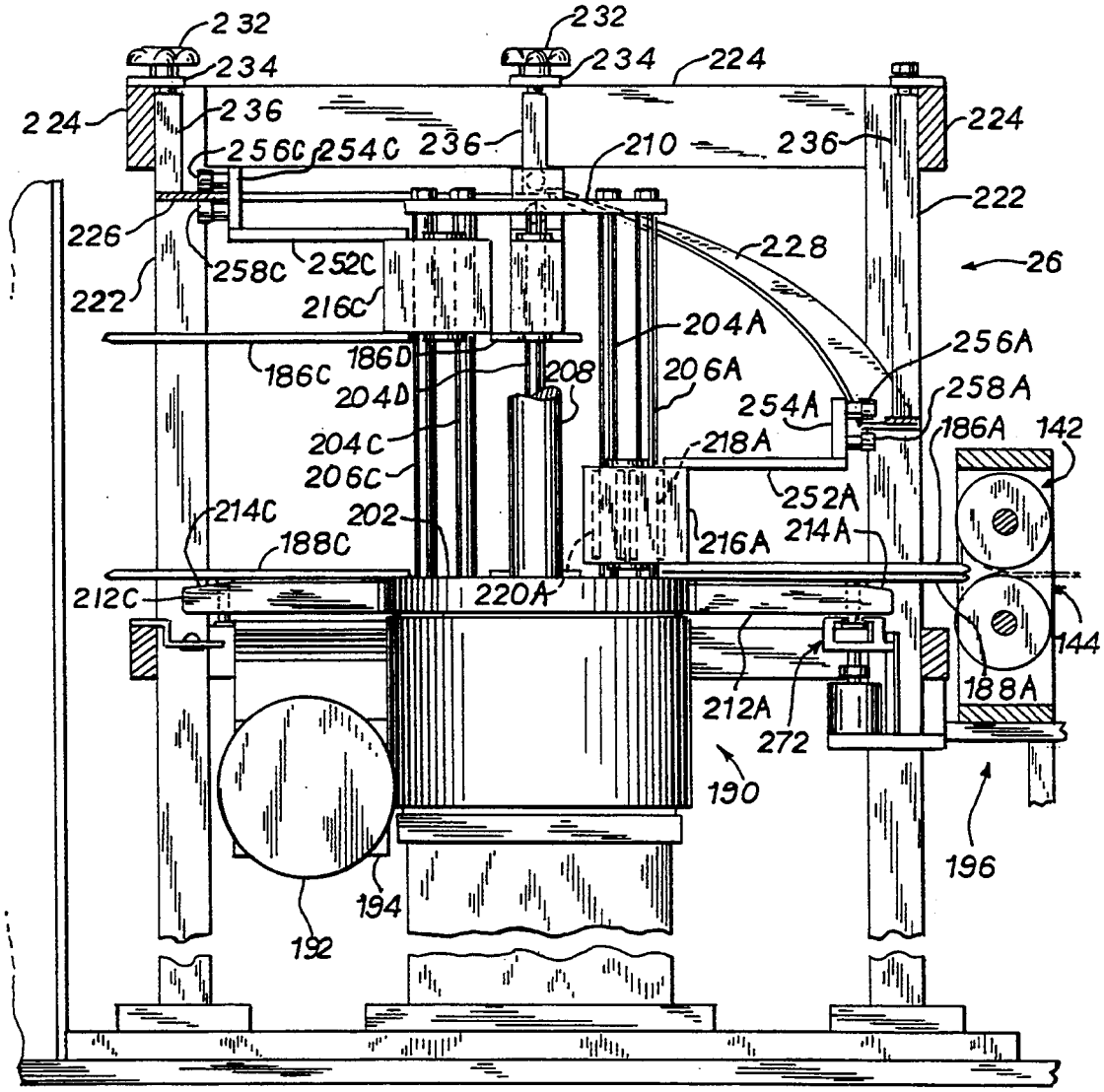
FIG. 7 is a partial section view taken along line 7—7 of FIG. 6.
Figure 8:
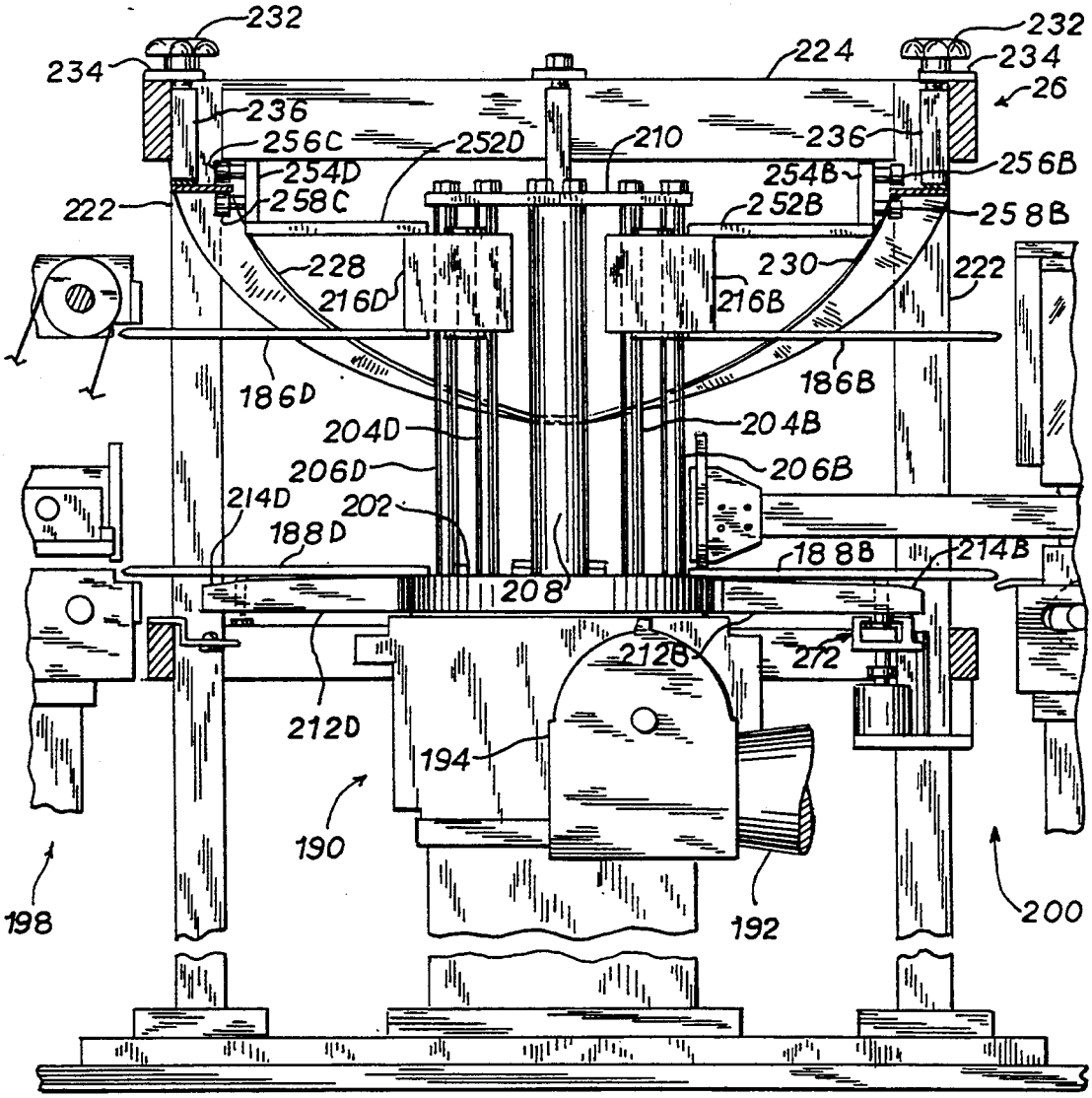
FIG. 8 is a partial section view taken along line 8—8 of FIG. 6.

Reference is now made to FIGS. 6–10 for a detailed explanation of the construction and operation of sleeve opening mechanism 26. As shown in FIGS. 6–8, sleeve opening mechanism 26 includes four identical pairs of plates or prongs, consisting of upper prongs **186*a*–186*d* and lower prongs 188*a*–188*d*. Any one of the sets of prongs are illustrated in FIG. 4 at 186, 188. The pairs of prongs are mounted to the upper portion of a pivoting turret mechanism, shown generally at 190 (FIGS. 7, 8). Representatively, turret mechanism 190 may be that such as is available from Commercial Cam Company, Inc., Emerson Electric Company, under its designation Camco, model 663RAD4H32-180, marked as being manufactured under one or more of the following U.S. Pat. Nos. 2,986,949; 3,282,387; 2,999,311; 3,525,268; and 3,049,017. Turret mechanism 180 is driven by a standard DC motor 192 through a conventional clutch and brake mechanism 194. Upon operation of motor 192 through clutch and brake mechanism 194, turret mechanism 190 functions to provide indexing rotational movement of the pairs of prongs 186***a*–186*d*, 188*a*–188*d* between a sleeving station 196 at which a sleeve 184 is placed onto the prongs, an inserting station 198, and a removal station 200.

A base plate 202 is mounted to the output shaft of turret mechanism 190, for indexing rotational movement in response to operation of turret mechanism 190 by motor 192. A series of guide posts 204*a*–204*d* and 206*a*–206*d* are mounted to base plate 202, extending upwardly therefrom. A central column 208 is also mounted to base plate 202, extending upwardly therefrom. A plate 210 is bolted to the upper end of column 208. In addition, the upper ends of each of guide posts 204*a*–204*d* and 206*a*–206*d* are bolted to plate 210. With this construction, guide posts 204*a*–204*d* and 206*a*–206*d* are rigidly mounted in a vertical position to base plate 202.

Each of lower prongs 188*a*–188*d* is connected at its inner end to the upper surface of base plate 202. In addition, a series of arms 212*a*–212*d* are mounted to base plate 202 extending outwardly therefrom, for supporting and clamping the portion of the sleeve beneath lower prongs 188*a*–188*d*, respectively, thereabove. Each of arms 212*a*–212*d* is provided with a ramped surface, shown at 214*a*–214*d*.

Upper prongs 186*a*–186*d* are mounted at their inner ends to the underside of blocks 216*a*–216*d*, respectively. Each of blocks 216*a*–216*d* has a pair of vertical passages extending between its upper and lower surfaces, through which guide posts 204*a*–204*d* and 206*a*–206*d*, respectively, extend. Linear bearing sleeves are preferably inserted into the passages in blocks 216*a*–216*d* for facilitating vertical sliding movement of blocks 216*a*–216*d* on posts 204*a*–204*d* and 206*a*–206*d*, respectively. Representatively, the linear bearing sleeves are illustrated in phantom in block 216*a* in FIG. 7, with the sleeves being shown at 218*a*, 220*a*.

A guide track is mounted above base plate 202 by a series of vertical frame members 222 and horizontal frame members 224. The guide track consists of several arcuate sections of bar stock, including a flat 180° section 226, an upwardly ramped 90° opening section 228, and a downwardly ramped 90° closing section 230. The vertical position of guide track sections 226–230 is adjustable in response to turning of adjustment knobs 232. Each of knobs 232 is mounted to the end of a threaded shank which extends through a horizontal plate 234 mounted to a horizontal frame member 224. The outer threaded end of the threaded shank is received within a threaded passage formed in a sleeve 236. The lower ends of sleeves 236 are secured to guide track sections 226–230, for providing adjustment in the vertical position of sections 226–230.

Figure 9:
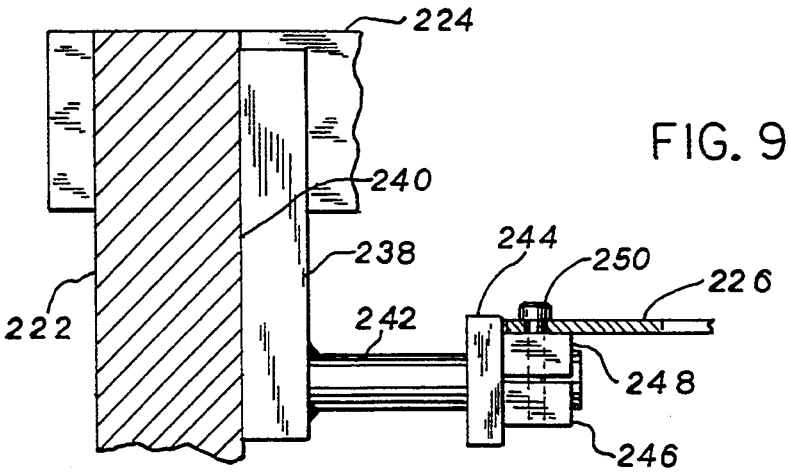
FIG. 9 is a partial section view taken along line 9—9 of FIG. 6.

FIG. 9 illustrates the manner in which guide track sections 226–230 are supported between sleeves 236. At each location of a vertical frame member 222, a bar 238 is mounted to a face 240 of the vertical frame member 222 by a variable position connection arrangement, such as via a series of threaded openings provided along the height of face 240, adapted to receive threaded fasteners extending through a slot formed in bar 238. A support shaft 242 is mounted to the lower end of bar 238, extending outwardly therefrom. A plate 244 has a passage within which support shaft 242 is received. A lower U-shaped clamp member 246 extends from the lower end of plate 244, and a vertical threaded passage is formed in U-shaped clamp member 246. A similar U-shaped clamp member 248 is positioned over support shaft 242. A threaded fastener 250 extends through an opening formed in each guide track section, such as section 226, and through vertical openings formed in upper clamp member 248 and shaft 242. The threaded end of threaded fastener 250 is engaged with the vertical threaded passage formed in lower clamp member 246, and turning fastener 250 down results in clamping of support shaft 242 between lower and upper clamp members 246, 248 to rigidly support guide track section 226.

As shown in FIGS. 7 and 8, arms 252*a*–252*d* are mounted to the upper ends of blocks 216*a*–216*d*, respectively, extending outwardly therefrom. Plates 254*a*–254*d* are mounted to the outer ends of arms 252*a*–252*d*, respectively. Upper and lower rollers 256*a*–256*d* and 258*a*–258*d*, respectively, extend outwardly from plates 254*a*–254*d*, respectively. Upper rollers 256*a*–256*d* are each located immediately above guide track sections 226–230, and rollers 258*a*–258*d* are located immediately below guide track sections 226–230.

Rollers 256*a*–256*d* and 258*a*–258*d* function as followers, engaging guide track sections 226–230 upon pivoting movement of turret mechanism 190 to move blocks 216*a*–216*d*, respectively upwardly and downwardly on guide posts 204*a*–204*d*, 206*a*–206*d*, respectively. Such upward and downward movement of blocks 216*a*–216*d* results in movement of each of prongs 186*a*–186*d* between its lowermost position, in which prong 186*a* is illustrated in FIG. 7, and its uppermost position, in which prong 186*c* is illustrated in FIG. 7.

Referring to FIG. 7, guide track section 230 functions to move each of upper prongs 186*a*–186*d* to its lowermost position, in which upper prongs 186*a*–186*d* are in very close proximity to lower prongs 188*a*–188*d*, respectively, at sleeving station 196. As explained previously, a collapsed tubular sleeve 184 of packaging material is partially opened by suction rolls 142, 144 and moved onto the collapsed prongs at sleeving station 196.

Figure 10:
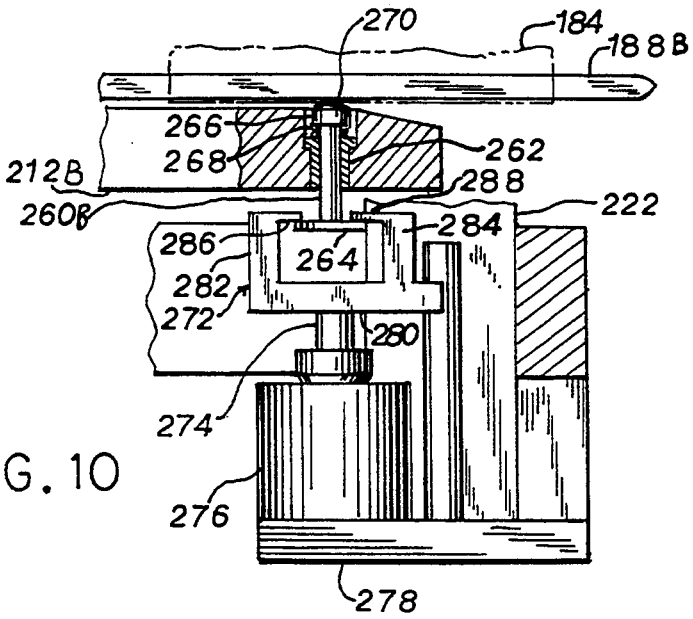
FIG. 10 is an enlarged partial section view showing a portion of the lower prong and a mechanism for retaining the sleeve in place on the lower prong.

Referring to FIGS. 7 and 10, a sleeve clamping rod, such as shown at 260*b*, is mounted to each of arms 212*a*–212*d*. Each clamping rod, such as 260*b*, extends through a passage formed in a sleeve 262 mounted in a mating passage extending through arm 212*b*. An actuator plate 264 is mounted to the lower end of rod 260*b*, and a clamping head 266 is mounted to the upper end of rod 260*b*. A spring 268 is interposed between the lower end of head 266 and the upper end of sleeve 262, for urging clamping head 266 toward the underside of prong 188*b*. A rubber disc 270 is mounted to the upper end of clamping head 266.

Actuator structure, shown generally at 272, (FIG. 10) is located at sleeving station 196 and at discharge station 200. Actuator structure 272 is mounted to the end of an extendible and retractable rod 274 associated with a pneumatic cylinder assembly 276. Cylinder 276 is supported by a plate 278 interconnected with one of vertical frame members 222.

Actuator structure 272 includes a base 280 and a pair of upstanding walls 282, 284. Base 280 and walls 282, 284 define a U-shape including a central channel within which actuator plate 264 is received when the arms, such as arm 212*b*, are pivoted to sleeving station 196 and discharge station 200.

Ears 286, 288 extend inwardly from the upper ends of walls 282, 284, respectively, and are located over the edges of actuator plate 264 when it is received within the channel defined by walls 282, 284 and base 280. With this arrangement, cylinder 276 is operable to retract rod 274 when the arm, such as arm 212*b*, reaches either sleeving station 196 or discharge station 200. This results in downward movement of actuator structure 272, and engagement of ears 286, 288 with actuator plate 264. The clamping rod, such as 260*b*, is then drawn downwardly against the force of the spring, such as 268, which biases the clamping rod upwardly, to move rubber disc 270 out of engagement with the underside of the lower prong, such as 188*b*. This way, a sleeve can be inserted onto or removed from the prongs without interference. Once the sleeve has been inserted on or removed from the prongs, cylinder assembly 276 is operated to again extend its rod 274, resulting in upward movement of actuator structure 272. Clamping rod 260*b* is thus moved upwardly under the influence of spring 268 for moving rubber disc 270 toward the underside of the lower prong, such as 188*b*, to clamp the lower wall of the sleeve in position on the prong. In this manner, the sleeve is maintained in position as the prongs move away from sleeving station 196, and at all locations between sleeving station 196 and discharge station 200.

Figure 11:
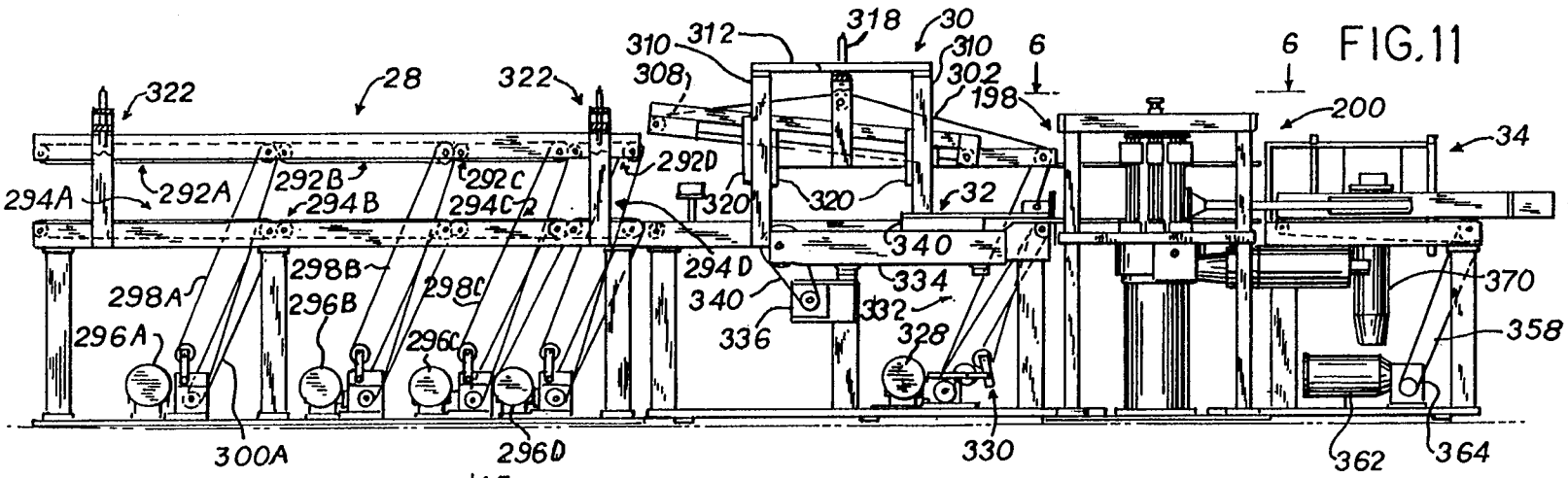
FIG. 11 is a side elevation view of the stack compression conveyor and the stack insertion and removal mechanisms of the packaging system of FIG. 1.
Figure 14:
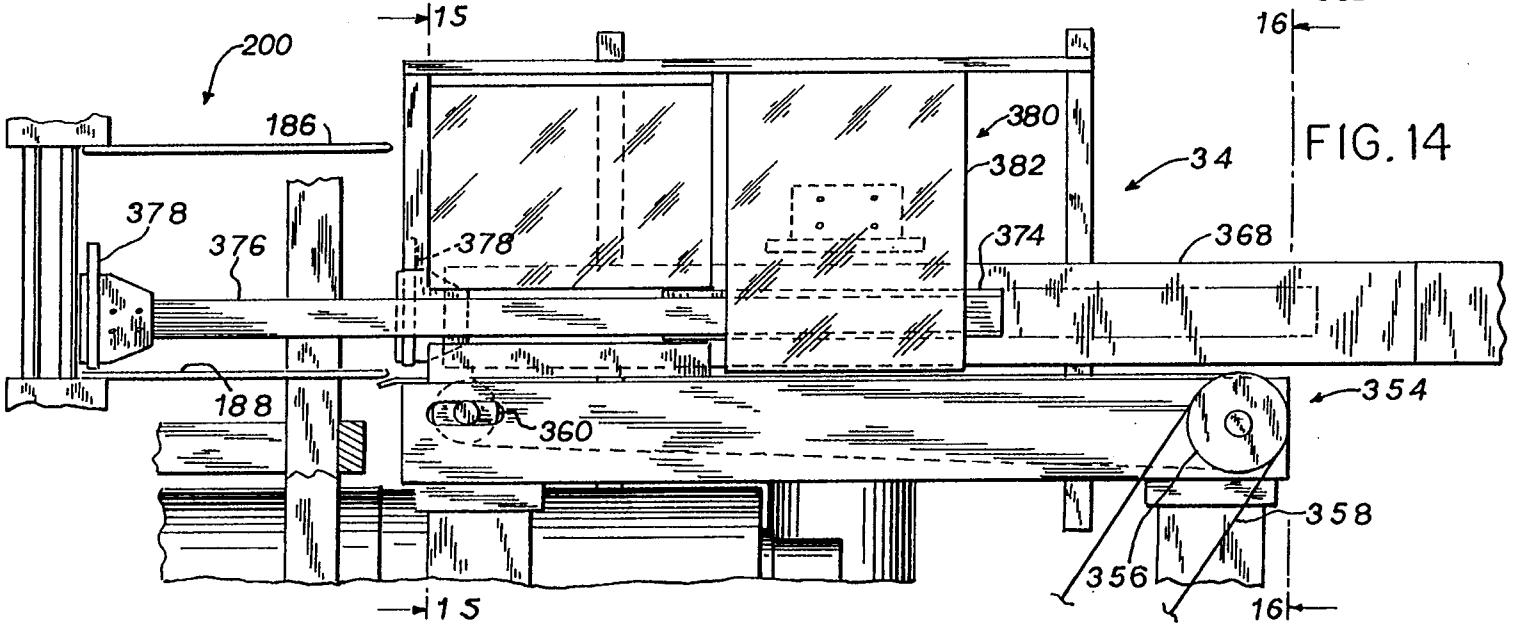
FIG. 14 is a partial side elevation view of the stack removal mechanism of the packaging system of FIG. 1, reference being made to line 14—14 of FIG. 1.

Referring to FIGS. 1 and 11, supply conveyor 28 receives individual stacks of articles, such as paper towels, from a paper towel folding and cutting machine, as is known. Supply conveyor 28 includes upper conveyors 292*a*, 292*b*, 292*c* and 292*d*, and lower conveyors 294*a*, 294*b*, 294*c* and 294*d*. Conveyors 292*a*, 294*a* are driven by a motor 296*a* through a belt drive arrangement including a belt 298*a* for driving upper conveyor run 292*a*, and a belt 300*a* for driving lower conveyor 294*a*. A similar motor and belt drive arrangement is provided for each of conveyors 292*b*–292*d* and 294*b*–294*d*.

The motors, such as shown in FIGS. 1 and 11 at 296*a*–296*d*, are variable speed DC motors which provide variable speeds of operation for conveyors 292*a*–292*d* and 294*a*–294*d*. In this manner, conveyors 292*a*–292*d* and 294*a*–294*d* are operable to remove gaps from between the successive groups of stacked articles, and to provide the stacks at a relatively close intermittent spacing to infeed conveyor 30. The speed of operation of motors 296*a*–296*d* is controlled in response to the spacing between successive groups of stacked articles as detected by photo eyes (not shown) in a manner as is known.

Figure 12:
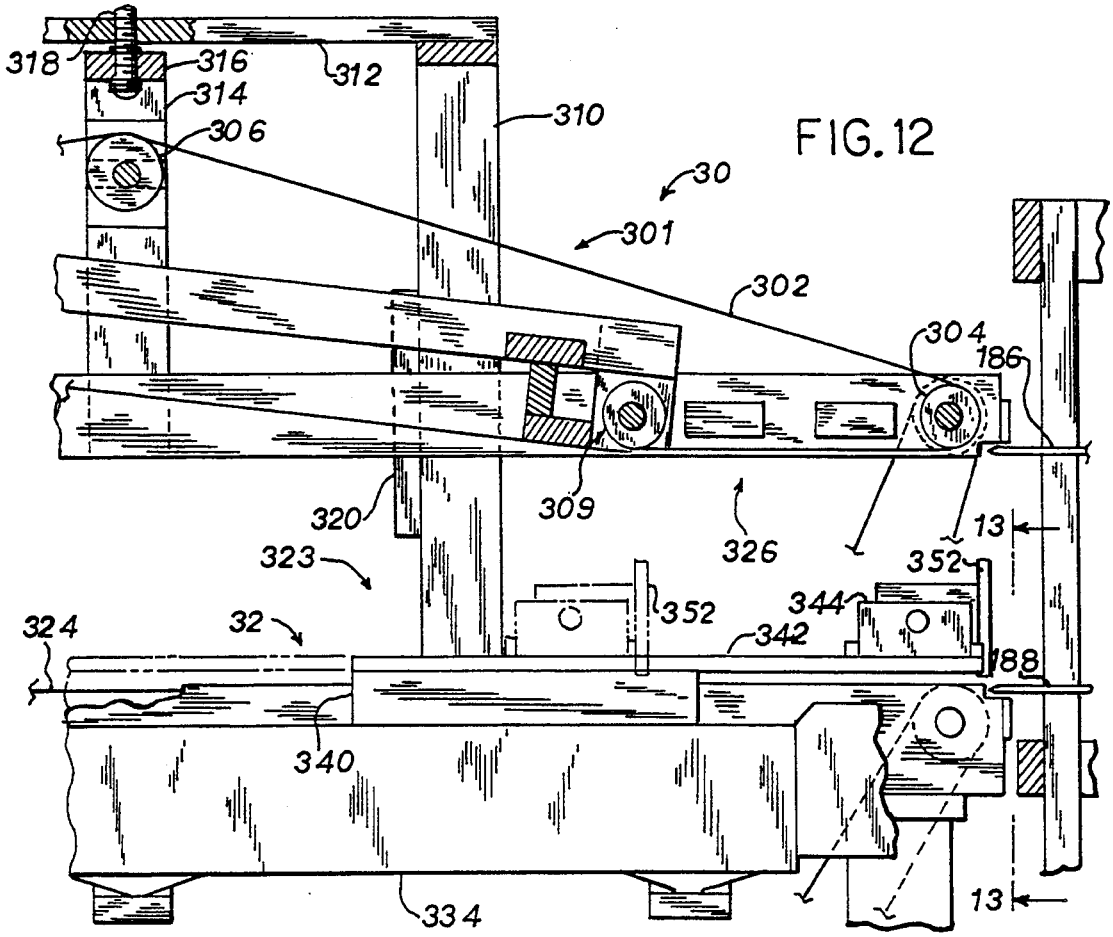
FIG. 12 is an enlarged partial side elevation view of the stack inserting mechanism of the packaging system of FIG. 1, reference being made to line 12—12 of FIG. 1.

Referring to FIGS. 11 and 12, infeed conveyor 30 includes an upper conveyor section 301 having a table top segmented plastic chain 302 trained about a forward drive roller 304, an upper idler roller 306, a rear idler roller 308 (FIG. 11) and an intermediate lower idler roller 309 (FIG. 12). Upper conveyor section 301 is mounted to a support frame consisting of a series of vertical frame members 310 and a horizontal upper frame member 312.

Upper conveyor section 301 is mounted to frame members 310 and 312 in a manner such that the lower run defined by chain 302 slopes downwardly in a rear-to-front direction between rear idler roller 308 and intermediate lower idler roller 309. The span of chain 302 between intermediate lower idler roller 309 and forward drive roller 304 is substantially horizontal.

An adjustable height mechanism is provided for adjusting the vertical position of upper conveyor section 301. The adjustable height mechanism consists of a frame assembly including a pair of vertical members 314 between which roller 306 extends, and an upper horizontal member 316 mounted at the upper ends of vertical members 314. A threaded shaft 318 is mounted at its lower end to horizontal upper member 316, extending upwardly through a threaded opening formed in horizontal frame member 312. With this arrangement, turning of threaded shaft 318 within the threaded opening formed in horizontal frame member 312 results in raising and/or lowering of upper conveyor section 301. Guide members, such as shown at 320, are interconnected with the frame assembly to which upper conveyor section 301 is mounted, and engage vertical frame members 310 for guiding upward and downward movement of upper conveyor section 301.

Similar height adjustment mechanisms, shown generally at 322, are provided at either end of supply conveyor 28.

Chain 302 of upper conveyor section 301 is the type of chain known as a table top chain, which is a segmented plastic chain assembly such as is available from chain suppliers such as Rexnord Corporation. The table top chain provides a smooth surface engaging the stack of paper towels transported thereby.

Infeed conveyor 30 also includes a lower conveyor section 323 (FIG. 12) including a chain 324. Lower chain 324 defines an upper run which is horizontal, and in alignment with lower conveyor runs 294*a*–294*d* of supply conveyor 28. Lower chain 324 is also a table top chain identical in construction to upper chain 302.

The upstream portion of upper chain 302 is arranged so as to converge toward lower chain 324 in a downstream direction. This construction functions to compress the stack of articles as it is advanced by upper and lower conveyor chains 302, 324. As noted previously, upper chain 302 includes a horizontal portion 326 (FIG. 12) at the downstream end of its lower run between rollers 304, 309, in which chains 302, 324 are parallel. At horizontal portion 326, the distance between upper chain 302 and lower chain 324 is slightly less than the distance between the upper and lower prongs, such as shown in FIG. 12 at 186, 188, when the prongs are at inserting station 198.

Upper and lower conveyor chains 302, 324 are driven by a motor 328 through a series of sprockets 330 and belts 332 (FIG. 11) in a conventional manner.

Inserting mechanism 32 is located toward the downstream end of infeed conveyor 30, and generally consists of a linear actuator 334 (FIGS. 11, 12) driven by a programmable servo motor 336 (FIGS. 1, 11). A belt 340 interconnects the output of motor 336 with the input of linear actuator 334. Actuator 334 is a belt-type linear actuator such as is available from Warner Electric under the designation "Rapidtrak". Actuator 334 includes an output member 340 movable in a back and forth manner in response to the input provided to actuator 334 by motor 336 and belt 340. Referring to FIGS. 12 and 13, an elongated bar 342 is mounted to output member 340 of actuator 334. A block 344 is mounted at the forward end of bar 342, and a double acting pneumatic cylinder assembly 346 having an extendible and retractable rod 348 is mounted to block 344. A plate 350 is mounted to the inner end of rod 348, and a pusher paddle 352 is mounted to plate 350. Cylinder 346 functions to move paddle 352 between its solid line position of FIG. 13, in which paddle 352 is positioned between infeed conveyor chains 302, 324, and a retracted position shown in phantom in FIG. 13 in which paddle 352 is withdrawn from between chains 302, 324.

Linear actuator 334, through its output member 340, functions to move paddle 352 between a forward position shown in solid lines in FIG. 12, in which paddle 352 is located between upper and lower prongs 186, 188, and a rearward position shown in phantom in FIG. 12.

In operation, cylinder assembly 346 functions to move paddle 352 to its retracted position during operation of actuator 334 providing rearward movement of paddle 352. After paddle 352 has been moved to its rearward position, cylinder assembly 346 functions to move paddle 352 to its operative position between conveyor belts 302, 324, where paddle 352 remains during forward movement in response to operation of actuator 334 for moving paddle 352 between its rearward position and its forward position. As will be explained, this operation of inserting mechanism 32 functions to advance a stack of articles from between belts 302, 324 and into the space defined between prongs 186, 188 at inserting station 198.

Referring to FIGS. 11 and 14–16, removing mechanism 34 is located at removal station 200, and includes a discharge conveyor 354. Discharge conveyor 354 is conventional in construction, including a driven roller 356 driven by a belt 358, trained about roller 356 and an idler roller 360. A motor 362 (FIG. 11) operates discharge conveyor 354 through belt 358 and a gear box 364. A conveyor belt 366 is trained about drive roller 356 and idler roller 360.

Removing mechanism 34 includes a belt-type linear actuator 368, again such as is available from Warner Electric under its designation "Rapidtrak", operated by a motor 370 through a drive arrangement including a belt 372, providing input to linear actuator 368 through an input pulley. Linear actuator 368 includes an output member 374, to which an elongated bar 376 is mounted. A paddle 378 is mounted at the end of bar 376. Paddle 378 is movable in response to operation of linear actuator 368 between a rearward position shown in solid lines in FIG. 14, and a forward position shown in phantom in FIG. 14. When paddle 378 is in its rearward position, paddle 378 is positioned between upper and lower prongs, shown in FIG. 14 at 186, 188, respectively. When paddle 378 is moved to its forward position, paddle 378 is withdrawn from between prongs 186, 188.

Removing mechanism 34 further includes a reject mechanism 380. Reject mechanism 380 consists of a plate 382 mounted to the end of an extendible and retractable rod 384 associated with a pneumatic cylinder assembly 386. Pneumatic cylinder assembly 386 is operable to move plate 382 between a retracted position, shown in solid lines in FIG. 16, and an extended position shown in phantom in FIG. 16. In its extended position, plate 382 is moved across discharge conveyor belt 366, with its lower end being in close proximity to the upper surface of belt 366.

Reject mechanism 380 is operable in response to a pair of photo eyes positioned at predetermined elevations above the upper surface of discharge conveyor belt 366. A lower photo eye is operative to signal the presence of a stack of articles on discharge conveyor belt 366 having a predetermined height. If the lower photo eye does not sense the presence of a stack, reject mechanism 380 is operated to move plate 382 to its extended position, to remove from discharge conveyor 366 any articles which may be present thereon. An upper photo eye is at an elevation positioned above the height of a normally packaged stack of articles. If the upper photo eye senses the presence of anything at this elevation, this typically means that the sleeve within which the stack has been packaged has failed, and reject mechanism 380 is operated to move plate 382 to its extended position, to remove any such articles from belt 366.

Any articles removed from belt 366 by reject mechanism 380 are kicked onto a ramp 388, below which a reject bin is placed for receiving any rejected articles.

When prongs 186, 188 are pivoted to removal station 200, paddle 378 is positioned behind the stack of articles between prongs 186, 188 and behind sleeve 184 within which prongs 186, 188 are located. Paddle 378 is then moved to its forward position, to withdraw the stack of articles from between prongs 186, 188 and to simultaneously remove sleeve 184 from prongs 186, 188. Upon removal of the stack of articles and sleeve from prongs 186, 188, the stack of articles undergoes decompression, expanding into engagement with the sleeve as the stack and sleeve are being withdrawn from prongs 186, 188. The sleeved stack is then deposited onto discharge conveyor belt 366, for transport downstream to a collecting bin or to a further downstream conveyor.

At removal station 200, prongs 186, 188 are moved slightly closer together than at inserting station 198, by guide track section 226. This functions to increase the amount of compression of the stack, while relieving the tautness of sleeve 184. This facilitates removal of the sleeve from prongs 186, 188.

Referring to FIG. 1, an electrical enclosure 390 houses the wiring and controls for the various mechanisms of sleeving system 20.

Figure 17:
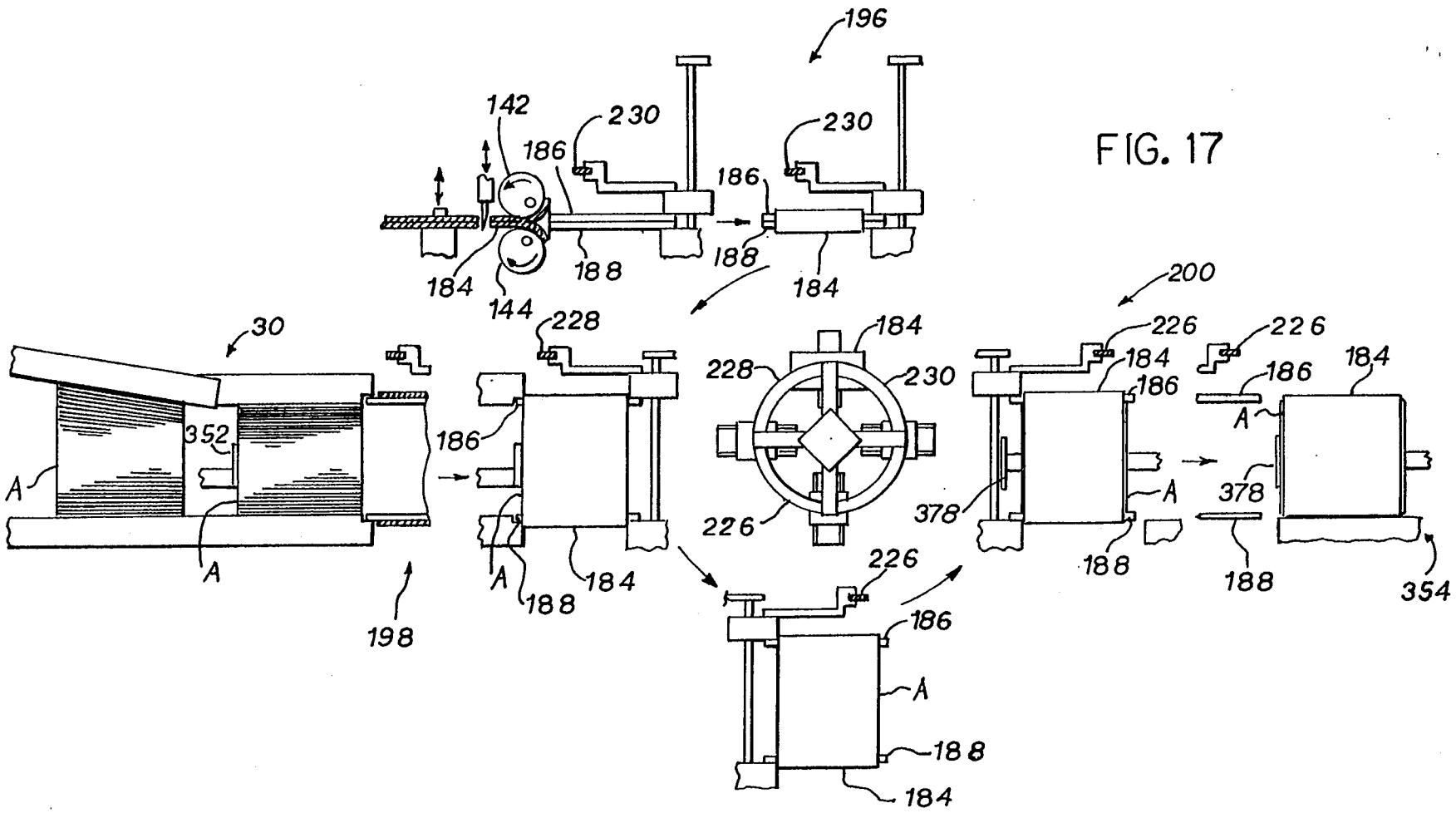
FIG. 17 is a schematic representation illustrating the steps involved in the operation of the packaging system of FIG. 1.

FIG. 17 schematically illustrates operation of sleeving system 20 and the steps involved in packaging a stack of articles at the various stations of sleeving system 20. At sleeving station 196, a sleeve 184 is produced as described previously and fed by suction rolls 142, 144 onto the collapsed prongs, such as 186, 188 moved together by operation of guide track section 230. The sleeve 184 is then clamped in position by the clamping assembly of FIG. 10 against the underside of lower prong 188, and prongs 186, 188 are moved by turret mechanism 190 to inserting station 198. The stacks of articles A are shown being supplied by infeed conveyor 30 and compressed at the discharge of infeed conveyor 30 by upper conveyor section 301. During movement of prongs 186, 188 to inserting station 198, prongs 186, 188 are moved apart by guide track section 228, to open sleeve 184. Pusher paddle 352 is moved laterally into position by cylinder assembly 346 behind the trailing end of the stack, and linear actuator 334 of inserting mechanism 32 is operated to move paddle 352 forwardly into engagement with the trailing end of the stack. The rate of movement of paddle 352 exceeds that of conveyor belts 302, 324 of infeed conveyor 30, and the stack is pushed off of infeed conveyor 30 into the space between prongs 186, 188, and thereby into opened sleeve 184. The turret mechanism is then operated to index prongs 186, 188 another 90°, and then yet another 90° to removal station 200. Removal paddle 378 of removing mechanism 34 is in its rearward position as prongs 186, 188 are moved toward removal station 200, and is located behind the stack when prongs 186, 188 are into position at removal station 200. At removal station 200, guide track section 226 is at a slightly lower elevation than guide track section 226 at inserting station 198, to compress the stack of articles A and to loosen the tautness of sleeve 184 at removal station 200. Linear actuator 368 of removing mechanism 34 is then operated to bring removal paddle 378 into engagement with the trailing end of the stack and with sleeve 184, to remove the stack from between prongs 186, 188 and to draw sleeve 184 off of prongs 186, 188. During removal of the stack from between prongs 186, 188, the emerging portion of the stack decompresses and expands into engagement with the inside of sleeve 184, and the stack is then engaged by friction throughout its periphery with the interior of sleeve 184. Linear actuator 368 of removing mechanism 34 continues to draw the stack and sleeve 184 forward until full disengagement of the stack and sleeve 184 from prongs 186, 188, and the sleeved stack is then deposited onto discharge conveyor 354.

As can be appreciated, a set of prongs is located at each of sleeving station 196, inserting station 198 and removal station 200 at all times, providing efficient and rapid sleeving of successive stacks of articles.

Figure 18:
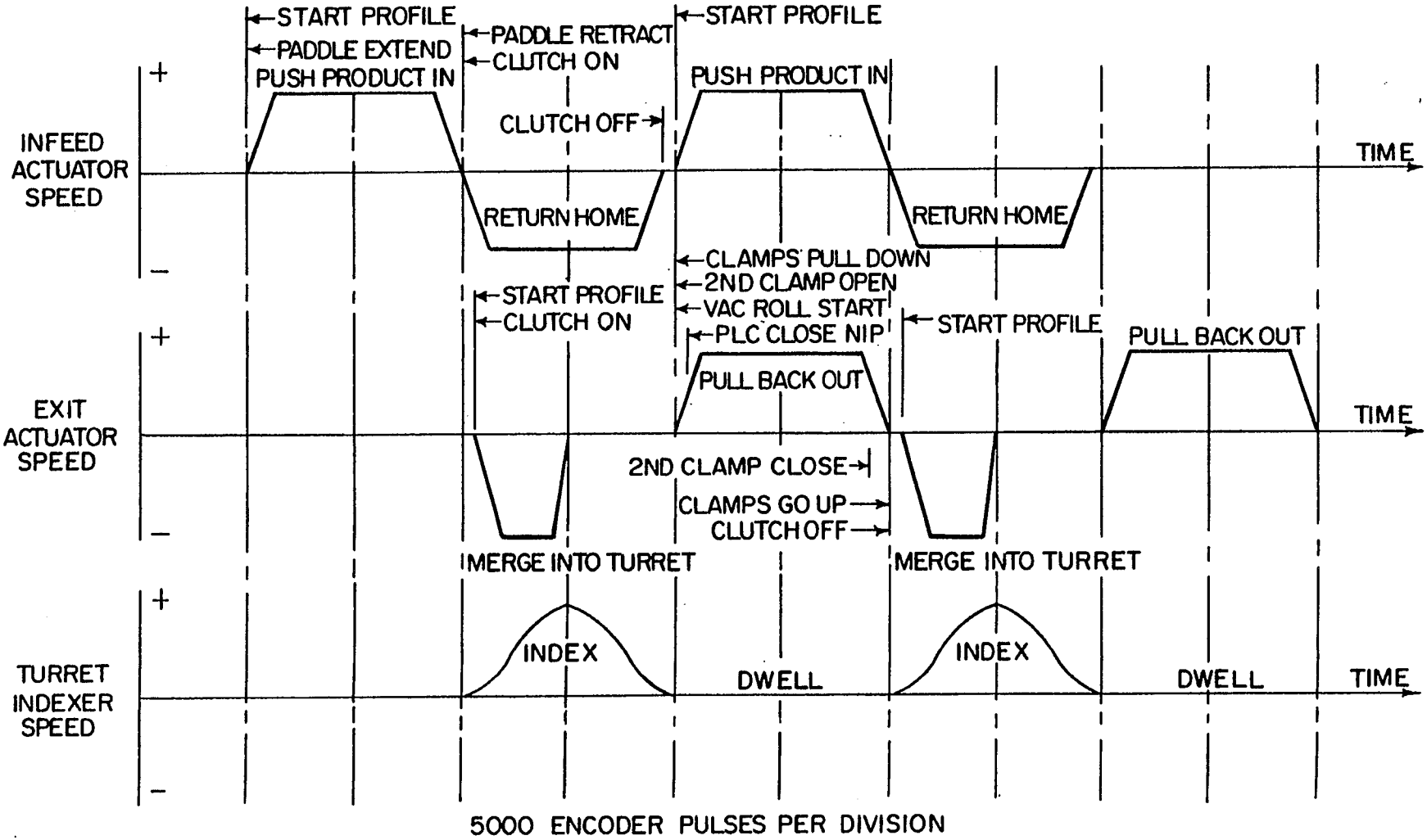
FIG. 18 is a timing diagram for the various operations carried out by the packaging system of FIG. 1.

FIG. 18 illustrates a timing diagram for the motors which operate the linear actuators of inserting mechanism 32 and removing mechanism 34, showing the timing of indexing movement of turret mechanism 90 and the points at which the various operations carried out by sleeving system 20 occur.

Various alternatives and embodiments are contemplated as being within the scope of the following claims particularly pointing out and distinctly claiming the subject matter regarded as the invention.

I claim:

1. A method of packaging a compressible stack of articles, comprising the steps of:

providing a sleeve in a collapsed conditions, the sleeve defining at least one open end;

moving the sleeve to an open position to open its open end by providing a pair of prongs positioned closely adjacent each other, partially opening the sleeve and placing the sleeve over the prongs, and moving the prongs apart to fully open the sleeve, wherein the step of partially opening the sleeve is carried out by a pair of suction rolls located adjacent the prongs and defining a nip to which the sleeve is supplied, wherein the suction rolls function to draw the walls of the sleeve apart to partially open the sleeve while simultaneously propelling the sleeve toward the prongs upon rotation of the suction rolls;

compressing the stack of articles;

inserting the compressed stack of articles into the sleeve through its opened end; and decompressing the stack of articles, wherein the stack of articles engages the sleeve and is retained by friction with the sleeve.

2. The method of claim 1, wherein the step of providing a sleeve comprises the steps of providing a parent roll of web material, forming a continuous tube from the web material by folding and gluing the web material, and severing the continuous tube at predetermined spacing to form each sleeve.

3. The method of claim 1, wherein the step of moving the prongs apart is carried out by means of a guide track with which the prongs are interconnected, wherein the guide track functions to provide movement of the prongs toward and away from each other.

4. The method of claim 3, wherein the step of moving the prongs apart includes mounting the prongs to a pivotable turret mechanism, mounting the guide track at a location spaced from the pivotable turret mechanism, and operating the turret mechanism to provide arcuate movement of the prongs, wherein the guide track moves the prongs toward and away from each other upon arcuate movement of the prongs during operation of the turret mechanism.

5. The method of claim 1, wherein each stack of articles defines a leading end and a trailing end, and wherein the step of inserting the compressed stack of articles into the opened sleeve comprises engaging a pusher member with the trailing end of the stack and moving the pusher member toward the prongs, to insert the stack of articles between the prongs and into the sleeve.

6. The method of claim 1, wherein the step of decompressing the stack of articles comprises removing the stack and the sleeve from the prongs.

7. The method of claim 6, wherein each stack of articles defines a leading end and a trailing end, and wherein the step of removing the stack of articles and the sleeve from the prongs comprises engaging a paddle member with the trailing end of the stack and with the sleeve, and moving the paddle member away from the prongs to draw the stack of articles and the sleeve away from the prongs.

8. A system for packaging a compressible stack of articles, comprising:

an article feeding mechanism for supplying a stack of articles in a compressed state;

a sleeve feeding mechanism for supplying a collapsible tubular sleeve in a collapsed condition, the sleeve defining at least a first open end;

a sleeve opening mechanism for moving the sleeve from its collapsed condition to an open condition, comprising a pair of prongs movable between a first collapsed position in which the prongs are close together, and a second opened position in which the prongs are moved apart, wherein the pair of prongs include a first stationary prong and a second movable prong movable toward and away from the first stationary prong, wherein the movable prong is mounted for sliding movement to one or more guide posts, and wherein the sleeve feeding mechanism functions to place the sleeve onto the prongs when the prongs are in their first collapsed position, and wherein movement of the prongs to their second opened position functions to open the sleeve;

an inserting mechanism for inserting the compressed stack of articles into the opened end of the sleeve between the prongs when the sleeve is moved to its open condition by the sleeve opening mechanism; and a removing mechanism for removing the sleeve and the stack of articles from the sleeve opening mechanism, wherein removing the stack of articles from the sleeve opening mechanism, by operation of the removing mechanism, functions to allow the stack of articles to move away from its compressed state and into engagement with the sleeve;

wherein the prongs are mounted to a pivoting turret mechanism which functions to move the prongs between a sleeving station at which the prongs are in their first collapsed position and the sleeve feeding mechanism functions to place the sleeve onto the prongs; an inserting station at which the prongs are in their second opened position, wherein the sleeve opening mechanism functions to move the prongs from their first collapsed position to their second opened position during movement of the prongs between the sleeving station and the inserting station; and a removal station at which the removing mechanism functions to remove the sleeve and the stack of articles from the prongs.

9. The packaging system of claim 8, wherein the stack of articles defines a leading end and a trailing end, and wherein the inserting mechanism includes a pusher member movable into engagement with the trailing end of the stack of articles, and a linearly movable mechanism to which the pusher member is mounted for moving the pusher member into engagement with the trailing end of the stack of articles and pushing the stack of articles into the opened sleeve between the pair of prongs.

10. The packaging system of claim 8, wherein the stack of articles defines a leading end and a trailing end, and wherein the removing mechanism includes a paddle member movable into engagement with the trailing end of the stack of articles, and a linearly movable mechanism to which the paddle member is mounted for moving the paddle member into engagement with the trailing end of the stack of articles and with the sleeve, for removing the stack of articles from between the prongs and simultaneously drawing the sleeve off of the prongs.

11. The packaging system of claim 8, wherein the sleeve opening mechanism comprises a guide track with which the movable prong is interconnected, wherein the guide track functions to provide sliding movement of the movable prong along the one or more guide posts toward and away from the stationary prong.

12. The packaging system of claim 11, wherein the guide track defines first and second spaced surfaces, and wherein the movable prong is interconnected with the guide track by means of one or more follower members engaged with the first and second spaced surfaces.

13. The packaging system of claim 12, wherein the first and second spaced surfaces of the guide track are defined by opposite sides of one or more bar members, and wherein the one or more follower members comprise a pair of spaced rollers, wherein each roller is engaged with one of the opposite sides of the one or more bar members.

14. A system for packaging a compressible stack of articles, comprising:

an article feeding mechanism for supplying a stack of articles in a compressed state;

a sleeve feeding mechanism for supplying a collapsible tubular sleeve in a collapsed condition, the sleeve defining at least a first open end, wherein the sleeve feeding mechanism comprises a parent roll of web material, an unwinding mechanism for unwinding the web material from the parent roll, a folding and gluing mechanism for forming the web material into a collapsed, folded continuous tube, a cutting mechanism for cutting the collapsed, folded continuous tube into collapsed sleeves of predetermined length, add a feeding mechanism for feeding the sleeve onto the sleeve opening mechanism, the feeding mechanism comprising a pair of rollers defining a nip for receiving a collapsed sleeve therebetween, wherein each roller includes one or more suction ports to which suction is applied;

a sleeve opening mechanism for moving the sleeve from its collapsed condition to an open condition, comprising a pair of prongs movable between a first collapsed position in which the prongs are close together and a second opened position in which the prongs are moved apart, wherein the suction ports of the rollers function to draw the walls of the collapsed sleeve apart to partially open the sleeve as the sleeve is propelled by the rollers toward the prongs, and wherein movement of the prongs to their second opened position functions to open the sleeve;

an inserting mechanism for inserting the compressed stack of articles into the first open end of the sleeve when the sleeve is moved to its open condition by the sleeve opening mechanism, wherein the inserting mechanism functions to insert the stack of articles into the open end of the sleeve between the prongs; and a removing mechanism for removing the sleeve and the stack of articles from the sleeve opening mechanism, wherein removing the stack of articles from the sleeve opening mechanism, by operation of the removing mechanism, functions to allow the stack of articles to move away from its compressed state and into engagement with the sleeve.

15. A sleeve supply mechanism for a packaging system for use in packaging a compressible stack of articles, comprising:

a sleeve feeding mechanism for supplying a collapsible tubular sleeve in a collapsed condition, the sleeve defining at least a first open end, wherein the sleeve feeding mechanism comprises a pair of rollers defining a nip for receiving a collapsed sleeve therebetween, wherein each roller includes one or more suction ports to which suction is applied; and a sleeve opening mechanism, comprising one or more pairs of prongs mounted for movement toward and away from each other, and a prong opening and closing arrangement interconnected with each pair of prongs for moving each pair of prongs toward each other to a first collapsed position adjacent the sleeve feeding mechanism, and for moving each pair of prongs away from each other to a second opened position upon movement of the pair of prongs away from the sleeve feeding mechanism, for opening the sleeve and for allowing a stack of articles to be inserted into the sleeve between the prongs, wherein the suction ports of the rollers function to draw the walls of the collapsed sleeve apart to partially open the sleeve as the sleeve is propelled by the rollers toward the pair of prongs.

16. A sleeve supply mechanism for a packaging system for use in packaging a compressible stack of articles, comprising:

a sleeve feeding mechanism for supplying a collapsible tubular sleeve in a collapsed condition, the sleeve defining at least a first open end; and a pivoting sleeve opening mechanism, comprising a pivotable turret mechanism and one or more pairs of prongs mounted to the turret mechanism, the pairs of prongs being mounted for movement toward and away from each other, and a prong opening and closing arrangement interconnected with each pair of prongs for moving each pair of prongs toward each other to a first collapsed position adjacent the sleeve feeding mechanism, and for moving each pair of prongs away from each other to a second opened position upon pivoting movement of the pair of prongs away from the sleeve feeding mechanism, for opening the sleeve and for allowing a stack of articles to be inserted into the sleeve between the prongs;

wherein each pair of prongs includes a first stationary prong and a second movable prong movable toward and away from the stationary prong, wherein the movable prong is mounted for sliding movement to one or more guide posts, and wherein the prong opening and closing arrangement includes a guide track with which each movable prong is interconnected, wherein the guide track functions to provide sliding movement of the movable prong along the one or more guide posts toward and away from the stationary prong.

17. The sleeve supply mechanism of claim 16, wherein the guide track defines first and second spaced surfaces, and wherein the movable prong is interconnected with the guide track by means of one or more follower members engaged with the first and second spaced surfaces.

18. The sleeve supply mechanism of claim 17, wherein the first and second spaced surfaces of the guide track are defined by opposite sides of one or more bar members, and wherein the one or more follower members comprise a pair of spaced rollers, wherein each roller is engaged with one of the opposite sides of the one or more bar members.

19. A sleeve feeding and opening mechanism for a packaging system for packaging a stack of compressible articles, comprising:

a pairs of prongs movable between a first collapsed position in which the prongs are close together and a second opened position in which the prongs are moved apart from each other; and a sleeve feeding mechanism for moving a sleeve onto the prongs when the prongs are in their first collapsed position, comprising a sleeve supply mechanism for providing a collapsible sleeve in a collapsed condition, and a pair of rollers defining a nip for receiving the collapsed sleeve therebetween, wherein each roller includes one or more suction ports to which suction is applied, wherein the suction ports of the rollers function to draw the walls of the sleeve toward the rollers to partially open the sleeve as the sleeve is propelled by the rollers toward the prongs in their first collapsed position.

20. The sleeve feeding and opening mechanism of claim 19, wherein each roller includes a stationary plate member defining inner and outer side surfaces, the plate member having a suction supply passage extending between its inner and outer side surfaces, wherein suction is applied to the suction supply passage and communicated therethrough to the inner side surface of the plate member, each roller further including a rotatable roller member defining an outer roller surface and a side surface facing the inner side surface of the plate member and in close proximity thereto, the rotatable member having a plurality of transverse passages extending inwardly from the side surface, and one or more secondary passages extending between each primary passage and the outer roller surface, wherein suction is applied to the roller surface of the roller member through each primary passage and its associated secondary passages as each primary passage passes over the suction supply passage of the plate member upon rotation of the roller member, whereby suction supplied to the roller surface of each roller functions to draw the walls of the collapsed sleeve apart to partially open the sleeve as the sleeve is propelled toward the prongs.

* * * * *

UNITED STATES PATENT AND TRADEMARK OFFICE

CERTIFICATE OF CORRECTION

PATENT NO. : 5,367,858

DATED : November 29, 1994

INVENTOR(S) : ANDREW L. HAASL

It is certified that error appears in the above-identified patent and that said Letters Patent is hereby corrected as shown below:

In The Claims

CLAIM 1, Col. 13, Line 39, delete "conditions" and substitute therefor -- condition --; CLAIM 14, Col. 15, Line 65, delete "add" and substitute therefor -- and --; CLAIM 19, Col. 17, Line 37, delete "pairs" and substitute therefor -- pair --.

Signed and Sealed this

Thirty-first Day of January, 1995

Bruce Lehman

*Attest:*

BRUCE LEHMAN

*Attesting Officer*

*Commissioner of Patents and Trademarks*